US007033973B2

(12) United States Patent
Fenzi

(10) Patent No.: US 7,033,973 B2
(45) Date of Patent: Apr. 25, 2006

(54) SUPPORT MEANS FOR SUBLIMATION DECORATIONS AND RELATIVE METHOD

(75) Inventor: Giancarlo Fenzi, Soave (IT)

(73) Assignee: V.I.V. International S.p.A., Cazzano di Tramigna (IT)

( * ) Notice: Subject to any disclaimer, the term of this patent is extended or adjusted under 35 U.S.C. 154(b) by 125 days.

(21) Appl. No.: 10/133,765

(22) Filed: Apr. 26, 2002

(65) Prior Publication Data

US 2002/0193249 A1 Dec. 19, 2002

(30) Foreign Application Priority Data

Apr. 27, 2001 (IT) ..... MO2001A0077

(51) Int. Cl.
*B41M 5/035* (2006.01)
*B41M 5/38* (2006.01)

(52) U.S. Cl. ..... 503/227; 427/152; 428/78; 428/79; 428/191

(58) Field of Classification Search ..... 503/227; 8/471; 428/78, 79, 191; 427/152
See application file for complete search history.

(56) References Cited

U.S. PATENT DOCUMENTS

| | | | | |
|---|---|---|---|---|
| 4,880,678 | A | 11/1989 | Goffi | 428/40 |
| 5,893,964 | A | 4/1999 | Claveau | 428/40 |

FOREIGN PATENT DOCUMENTS

| | | |
|---|---|---|
| EP | 0 451 067 | 10/1991 |
| EP | 0 893 274 | 1/1999 |
| EP | 0 921 014 | 6/1999 |
| EP | 1 055 524 | 11/2000 |
| EP | 1 092 550 | 4/2001 |
| IT | 210762 | 6/1987 |
| WO | WO 96/18509 | 6/1996 |

*Primary Examiner*—Bruce H. Hess
(74) *Attorney, Agent, or Firm*—Collard & Roe, P.C.

(57) ABSTRACT

Support means for sublimation decorations (2) comprise paper sheet means (4) arranged to receive on one face thereof (4*a*) said decorations (2), a further face (4*b*) of said sheet means (4) opposite the one said face (4*a*) being permanently associated with barrier means (5; 17, 18) arranged to hinder the passage of air through said further face (4*b*); a method for manufacturing support means (1) for sublimation decorations (2) comprises obtaining said decorations (2) on a face (4*a*) of paper sheet means (4), permanently associating with a further face (4*b*) of said sheet means (4) opposite the said one face (4*a*) barrier means (5; 17, 18) arranged to substantially prevent the passage of air through said further face (4*b*).

19 Claims, 6 Drawing Sheets

SUPPORT MEANS FOR SUBLIMATION DECORATIONS AND RELATIVE METHOD

The invention concerns support means for decorations that need to be transferred to objects to decorate them, in particular decorations comprising designs made with sublimation inks, and a method for manufacturing said support means.

For the decoration of objects, in particular metal profiled elements or the like, made, for example, from extruded aluminium or aluminium alloys, systems exist in the prior art for the transfer of ornamental images, such images being made with sublimation inks that are initially assigned to the relative support elements.

Such systems provide for the coupling of said support elements, which are usually obtained from laminae of sheet material, to the objects to be decorated and keeping them fixed to the latter by exerting pressure on them. The objects and the support elements coupled to them are then heated to promote the spread of above-mentioned sublimation inks, the particles of which are removed from the support elements and are deposited on the objects to reproduce on them the required decoration.

The support elements can be configured in such a way as to form a casing around the object that is to be decorated.

For such cases prior art apparatuses exist that are provided with devices that are suitable for aspirating the air found between the casing and the object contained in it to encourage the adhesion of a support element to the object.

As described in European patent application EP 1055524, the support elements can include sheets of calendered paper on which sublimation inks are used to obtain drawings to be transferred to the objects to be decorated.

Said patterns may be printed directly on the support elements or they can be transferred in the form of transfers.

Such sheets of paper are wound around the objects, after which opposite ends of them are fixed, for example by gluing, to obtain bags into which the objects are inserted.

Thereafter aspiration devices aspirate the air inside the bags to cause the sheets of paper to stick to the objects so that during the subsequent heating phase the image defined by the sublimation inks is clearly transferred to the surface of the objects.

One defect of the support elements made from sheets of paper consists of the fact that the paper is porous to a certain extent and this porosity means that it is not completely impermeable to the air. During the aspiration phase, therefore, a certain amount of air tends to enter the interior of the bags through the pores of the paper: as a result the support elements may be subject to slight shifts that may nevertheless affect the quality of the decorations transferred to the objects.

Moreover, owing to penetration of the air inside the bags, the pressure exerted on the support elements may be subject to variations, which may lead to defects in the definition of the decorations.

To overcome this disadvantage, the support elements made with sheets of paper may be used in combination with decorating contrivances provided with a pair of membranes supported on relative mobile frames that move towards and away from one another. The objects, around which the paper support elements have been previously wound, are inserted between the membranes, after which these latter are moved towards one another and the air found between them is aspirated. At the same time, the air found between the objects and the relative sheets of paper is also aspirated to avoid the formation of bubbles that would prevent the correct transfer of the decorations.

As the membranes are made of a deformable material, e.g. elastomeric material, they adhere to the objects and take on the shape of the objects and press on the surfaces of the objects the sheets of paper bearing the images to be impressed.

One defect of said contrivances consists in the difficulty of manufacturing and using said contrivances, these difficulties being substantially due to the use of complex deformable membrane devices.

A further defect of the support elements in paper is due to the fragility of the paper itself, which, during the decoration transfer phases, causes a large quantity of material to be produced that does not meet the set quality standards and which must therefore be rejected.

In the prior art support elements also exist that consist of plastic film that is impermeable to the air and that therefore substantially overcome the problems connected with the use of sheets of paper that have been pointed out above.

Said plastic support elements nevertheless have the defect of enabling partial spreading inside them of the particles of sublimation ink. During heating of the objects around which the support elements have been wound, part of the sublimation ink, instead of moving towards the surface of the objects to be decorated, penetrates the thickness of film and thereby wastes materials and lessens the intensity of the transferred image.

Various solutions have been adopted to remedy this disadvantage.

A first solution is the subject of industrial invention patent application MI97A002664 and of the corresponding European patent application EP 0921014, which describe support elements for decorations made with sublimation inks comprising a film or lamina of polymeric material and a layer of aluminium on which said decorations are made.

In this case the layer of aluminium acts as a barrier to the particles of sublimation ink and prevents them from spreading inside the polymeric film.

A second solution is the subject of the patent for utility model 210.762, which describes support elements for decorations made with sublimation inks comprising a sheet of polymeric material provided with a face covered with a layer of paint on which the images to be transferred are then created, said layer of paint being arranged to prevent the spread of the particles of said inks through the depth of the sheet.

One defect of the support elements described above consists of the fact that they are rather expensive because they must be clad with a layer of material that is impermeable to the particles of sublimation ink.

A further defect is the considerable difficulty in using the support elements and the decorations associated with them, this difficulty being due to the presence of the isolating layer.

One aim of this invention is to improve the support means for decorations made with sublimation inks.

Another aim of the invention is to obtain support means for decorations made with sublimation inks that enable optimal adhesion of the decoration to the objects to be decorated during the transfer phase.

A further aim of this invention is to obtain support means for decorations made with sublimation inks that substantially enable the formation of bubbles or trapped air between the object to be decorated and the support means to be prevented, the formation of bubbles or trapped air occurring frequently when prior-art support means are used.

Yet another further aim is to obtain support means for decorations made with sublimation inks that have good mechanical resistance and which are not therefore subject to breakages or deterioration during the phases of the productive cycle.

Another aim of the invention is to manufacture supports means for sublimation decorations in a simple and economical manner. A first aspect of the invention provides support means for sublimation decorations, comprising paper sheet means arranged to receive on one face thereof said sublimation decorations, characterised in that barrier means are permanently associated with a further face of said paper means opposite the one said face, said barrier means being arranged to substantially prevent air from passing through said further face.

In one advantageous version, said barrier means are arranged and formed so as not to prevent air moving inside the sheet means transversely to the thickness of the sheet means.

In another advantageous version, said barrier means comprise material means in the form of films that are impermeable to air.

In a further advantageous version, said material that is impermeable to air comprises polymeric material.

A second aspect of the invention provides a method for manufacturing support means for sublimation decorations, comprising obtaining said decorations on a face of paper sheet means characterised in the permanently associating barrier means with a further face of said sheet means opposite the one said face, the barrier means being arranged to substantially prevent the movement of air through said further face.

Preferably, said barrier means comprise sheet barrier means.

In one advantageous version, said association comprises placing a layer of glue means between said sheet means and said barrier means.

In addition, said obtaining comprises printing said decorations on one said face before and/or after said associating.

In a further advantageous version, said associating comprises distributing said barrier means in a fluid state onto said further face, through, for example, spreading or spraying. This aspect of the invention enables support means for decorations to be obtained using sublimation inks that enable a high quality of printing to be obtained. As air can pass transversely to the thickness of the paper sheet means, said paper sheet means enable movement and escape of the air from the support means once the latter have been wound round a manufactured product to be decorated or have constituted a casing suitable for containing said manufactured product.

Good adhesion of the decoration to the surface of the object to be decorated is thus obtained and therefore an optimal transfer of the images is obtained.

In particular, as the air may spread through the thickness of the paper sheet means bubbles that might remain trapped between the support means and the object to be decorated along the length of said object are substantially eliminated.

The coupling between paper sheet means and film means in plastic also enables support means provided with high mechanical resistance to be obtained.

In order that the invention may be clearly and completely disclosed, reference will now be made, by way of examples that do not limit the scope of the invention, to the accompanying drawings, wherein.

Figure 1:
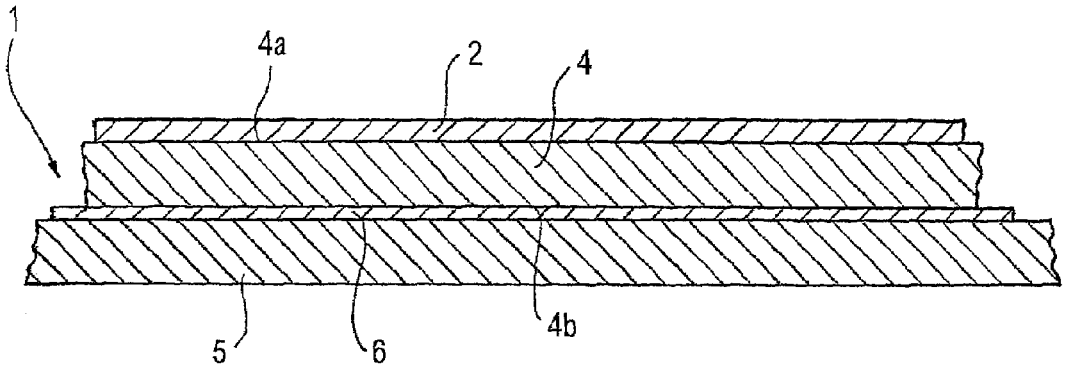
FIG. 1 is a section of a vertical plane of the support means according to the invention with which a decoration made with sublimation inks is associated.
Figure 2:
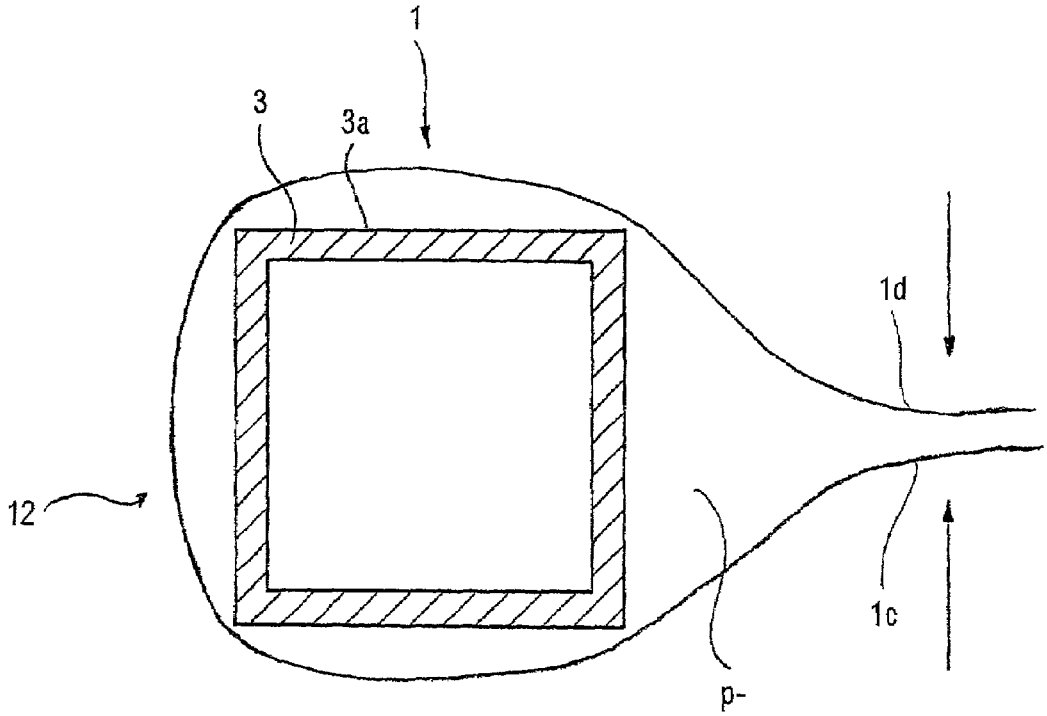
FIG. 2 is a section of a vertical plane of a manufactured product around which the support means of FIG. 1 have been wound.

FIGS. 1 and 2 show support means 1 that are suitable for receiving a decoration 2 made with sublimation inks for transferring it onto surfaces 3*a* of a manufactured product that is to be decorated such as a metal profiled element 3.

The support means 1 comprise a sheet of paper 4 comprising a first external face 4*a* on which decorations 2 are printed and a second external face 4*b*, opposite said first face 4*a*, firmly fixed, for example by means of a layer of glue 6, to a film of material that is impermeable to air, such as a film of polymeric material 5.

Figure 7:
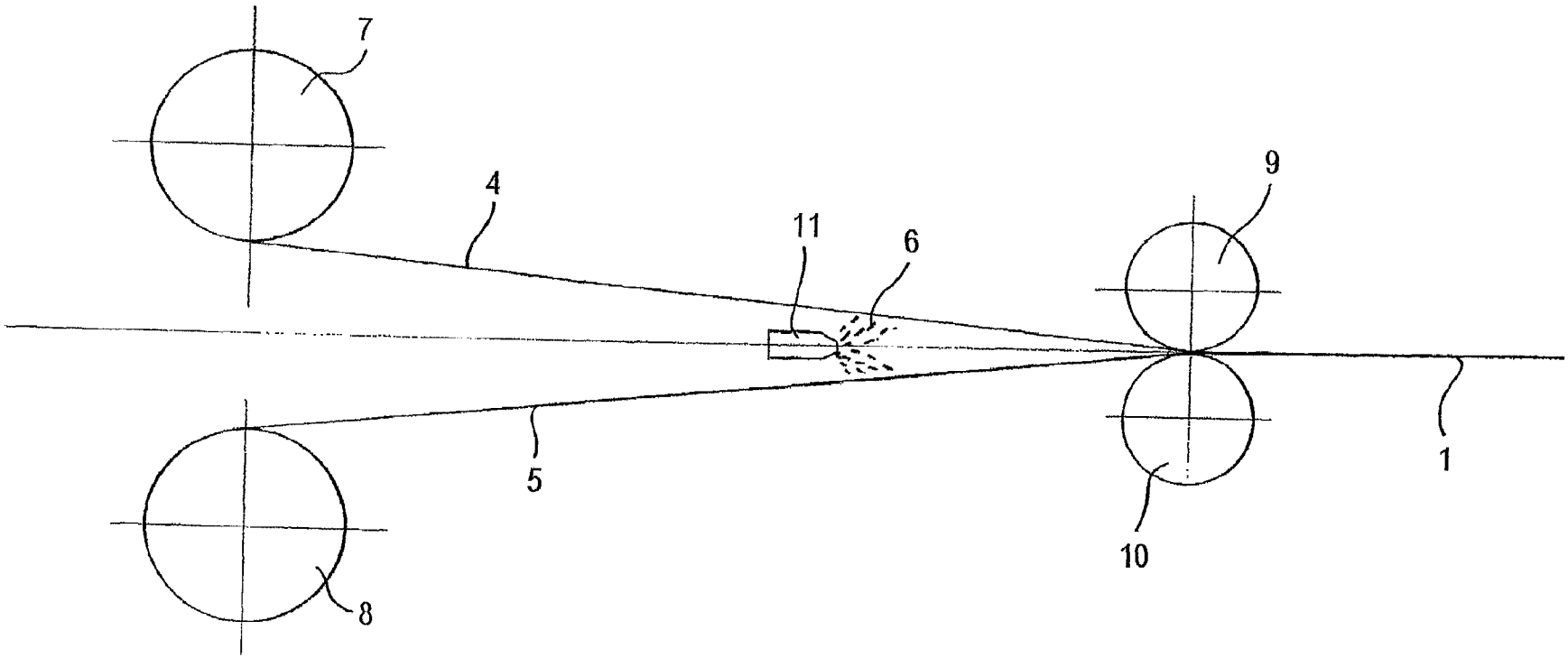
FIG. 7 is a drawing of the side of a contrivance for producing support means according to the invention, in a first version.

FIG. 7 shows a drawing of a possible version of a contrivance for the production of support means 1 according to the invention comprising a first reel 7 from which the sheet of paper 4 is unwound and a second reel 8 from which the film of polymeric material 5 is unwound.

The contrivance also comprises a pair of presser rollers 9, 10, which face each other, between which the sheet of paper 4 and the film of polymeric material 5 are passed to obtain the support means 1. Upstream of the pair of rollers 9, 10 nozzle means 11, or roller means are arranged to distribute the glue 6 by placing it between the sheet of paper 4 and the film of polymeric material 5.

Downstream of the pair of rollers 9, 10 printing means are provided, which are not shown, which are suitable for making the decorations 2 on the aforesaid sheet of paper 4, said printing means may, for example, comprise gravure printing means, flexographic printing means, off-set printing means, silkscreen printing means, ink-jet printing means, or other prior-art printing means.

Alternatively, paper sheet 4 can be provided with decorations 2 before being associated with the film of polymeric material 5.

Referring again to FIG. 2, the support means 1 showing the decorations 2 are wound around the profiled element 3 to form a casing 12 mutually fixing opposite flaps 1*c* and 1*d* of the support means 1.

The flaps 1*c* and 1*d* can be welded together, for example by means of ultrasound thermal welding, or they can be glued or they can simply be superimposed and mechanically connected, for example by means of adhesive tape.

After the profiled element has been enclosed in the casing means 12, using depressurising means that are not shown, a vacuum p− is created inside the casing 12 that causes the support means 1 to stick to the profiled element 3, thereby bringing the decorations 2 into contact with the surfaces 3*a* of the profiled element.

As the support means 1 are provided with said film of polymeric material 5 they ensure excellent impermeability to the air and significantly reduce, and in fact substantially eliminate positioning errors and/or possibility of moving the decorations 2 in relation to the profiled element 3 during sublimation of the inks that make up the decorations.

In addition, as the support means 1 comprise the paper sheet 4 the formation of even small air bubbles between the profiled element 3 and the paper sheet 4 has substantially been prevented: as the paper is permeable transversely to its thickness, the air inside the casing 12 can move through the support means 1 and be aspirated by the depressurising means, which are normally positioned at the end sections 13, 14 (FIG. 6) of the profiled element 3 and therefore of the casing 12.

Figure 6:
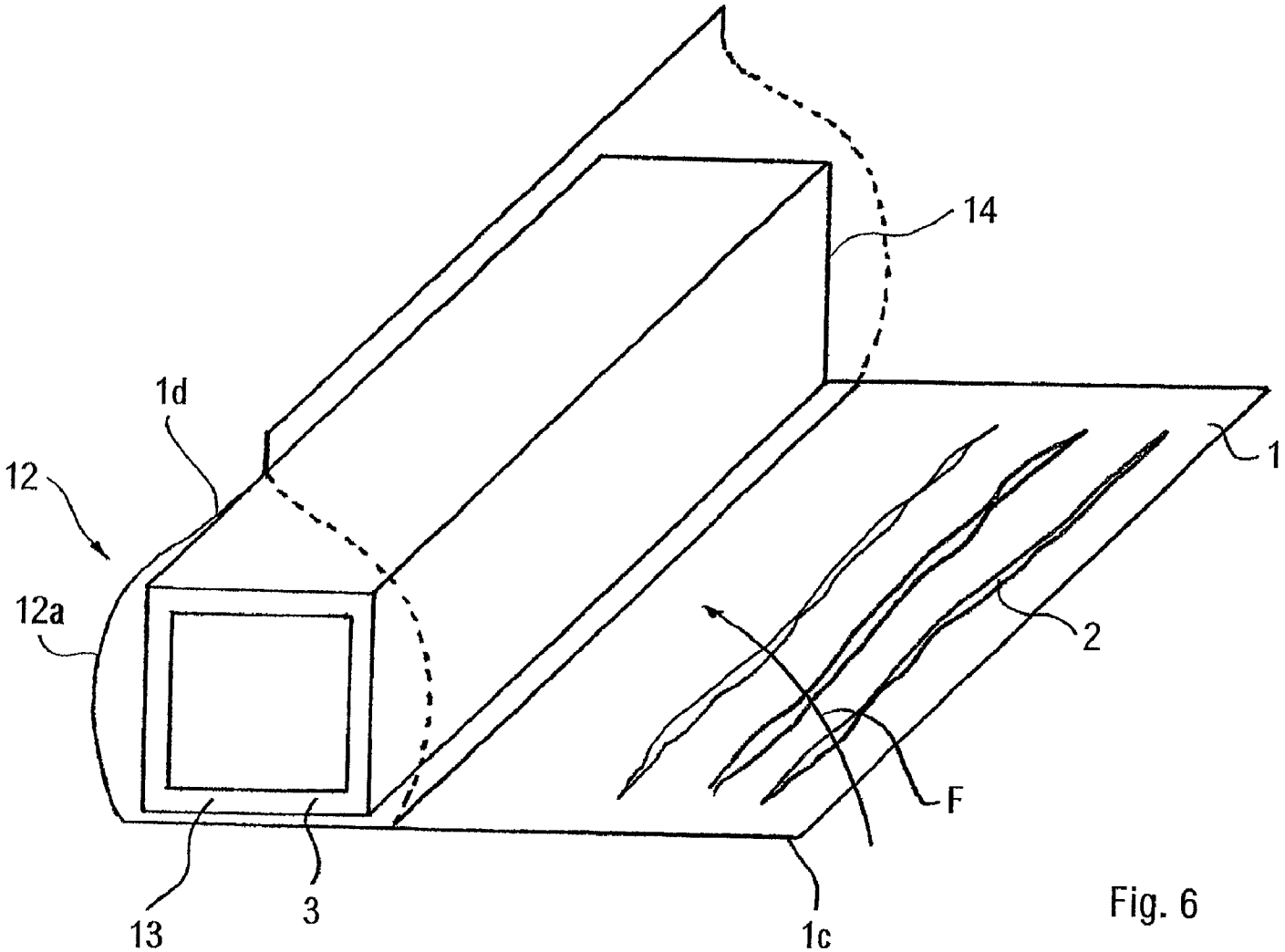
FIG. 6 is a perspective view showing a manufactured product to be decorated during the manual winding operations using the support means according to the invention.

FIG. 6 is a drawing of the manual winding operations of the support means 1 displaying the decorations 2 around a profiled element 3.

The profiled element 3 is positioned on the support means 1, after which the flap 1*d* is raised to constitute a first portion 12*a* of the casing 12; subsequently, the flap 1*c* is rotated by operators located at the opposite ends 13 and 14 of the profiled element 3, in the direction of arrow F to complete the casing 12.

The sheet of paper 4 is advantageously made in such a way that its fibres are substantially parallel to the length of the profiled element 3 and therefore has improved mechanical resistance in the direction of the above-mentioned length: this enables winding operations around the profiled element 3 to be facilitated inasmuch as the support means 1 are gripped at their ends by the above-mentioned operators and tend not to sag and to maintain a certain rigidity, even in the intermediate section. Folds in the support means 1 are thus substantially eliminated, which folds could create problems during the transfer of the decorations 2 and defects in the decorated manufactured products 3.

Figure 5:
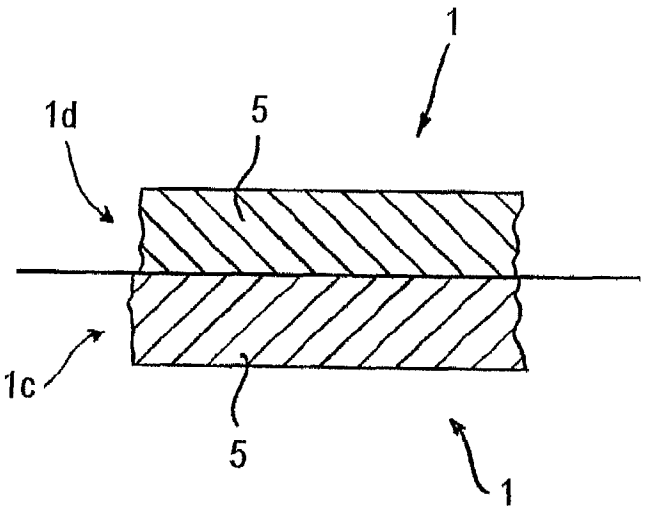
FIG. 5 is a section like the one in FIG. 4, showing the support means after the thermal welding operations.
Figure 4:
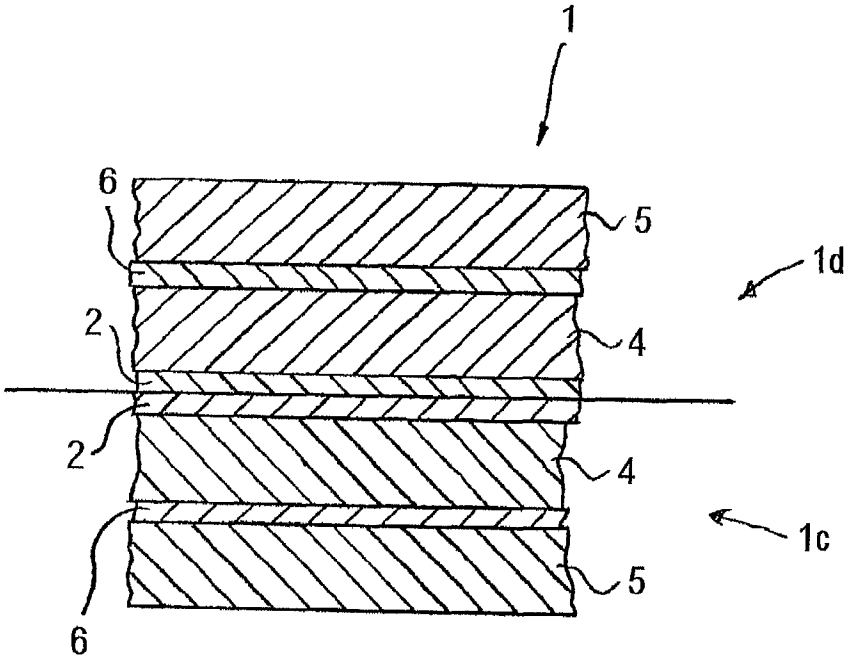
FIG. 4 is a section of a vertical plane of the support means of FIG. 1 folded to form a casing, in a phase preceding the operations of thermal welding the support means.

FIGS. 4 and 5 show that the flaps 1*c* and 1*d* of the support means 1 can be advantageously and mutually fixed by ultrasound thermal welding.

As FIG. 4 shows, the flaps 1*c* and 1*d* of the support means 1 making up the casing 12 are superimposed and made to interact with ultrasound welding means, which are not shown.

As FIG. 5 shows, due to the ultrasound radiation, the decoration 2, the sheet of paper 4 and the layer of glue 6 of each of the flaps 1*c*, 1*d* is subjected to a combustion process and is therefore eliminated. The film of polymeric material of the flap 1*c*, and the film of polymeric material of the flap 1*d*, on the other hand, are softened and, through the effect of pressure exerted on each of them, they weld together to ensure that the casing 12 is hermetically sealed.

Figure 3:
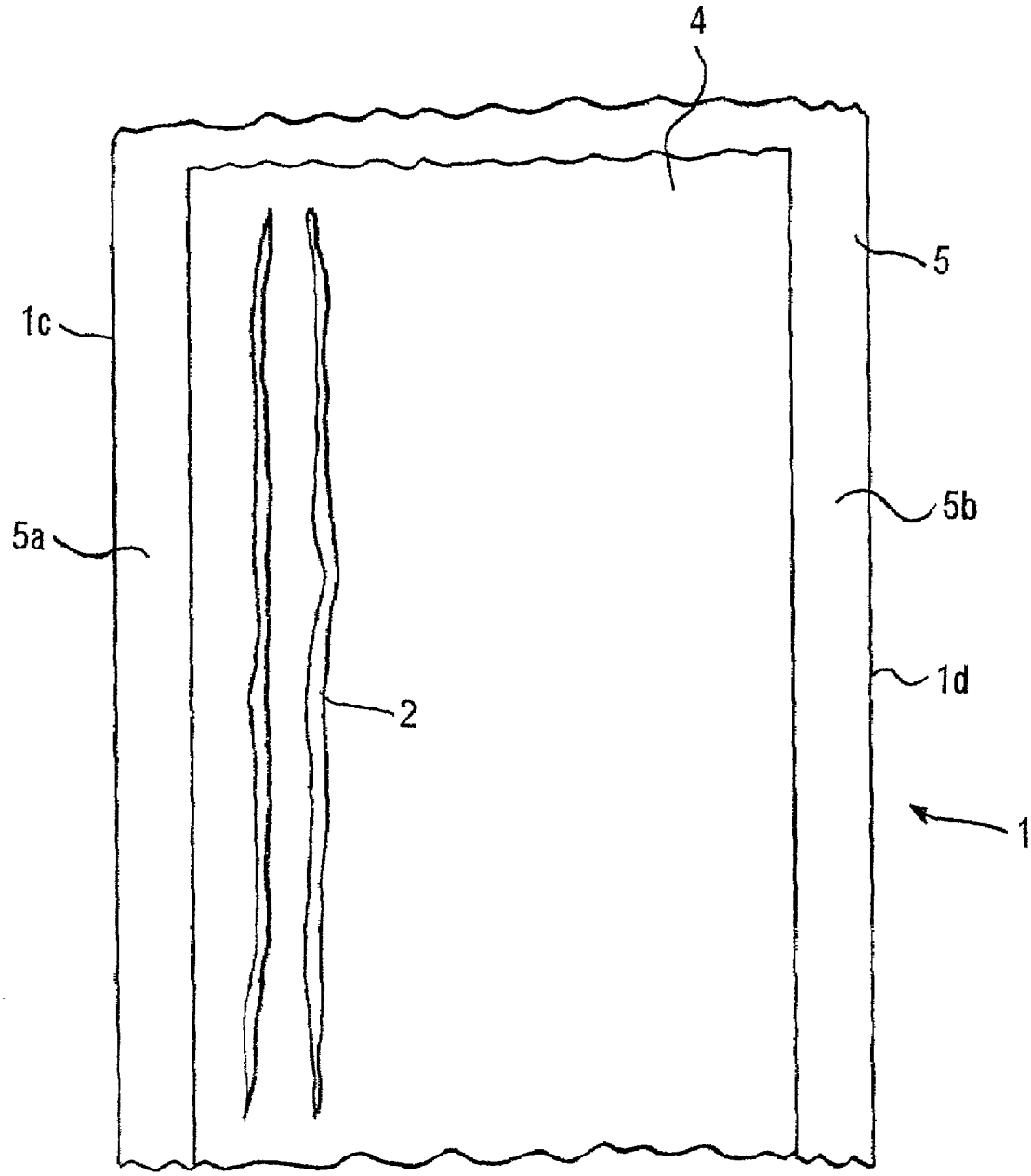
FIG. 3 is an interrupted plan view of the support means according to the invention, in a preferred version.

FIG. 3 shows a variation of the support means 1 according to the invention. In this case the above-mentioned support means 1 comprise a sheet of paper 4 having a transverse dimension that is less than the transverse dimension of the film of polymeric material 5 with which it is associated.

In this way, in the above-mentioned film of polymeric material 5 two end zones, 5*a* and 5*b*, are identified that are without the cladding constituted by the sheet of paper 4, the decoration 2 and the layer of glue 6, and are therefore suitable for fostering thermal welding when flaps 1*c* and 1*d* are brought into contact with one another.

Figure 8:
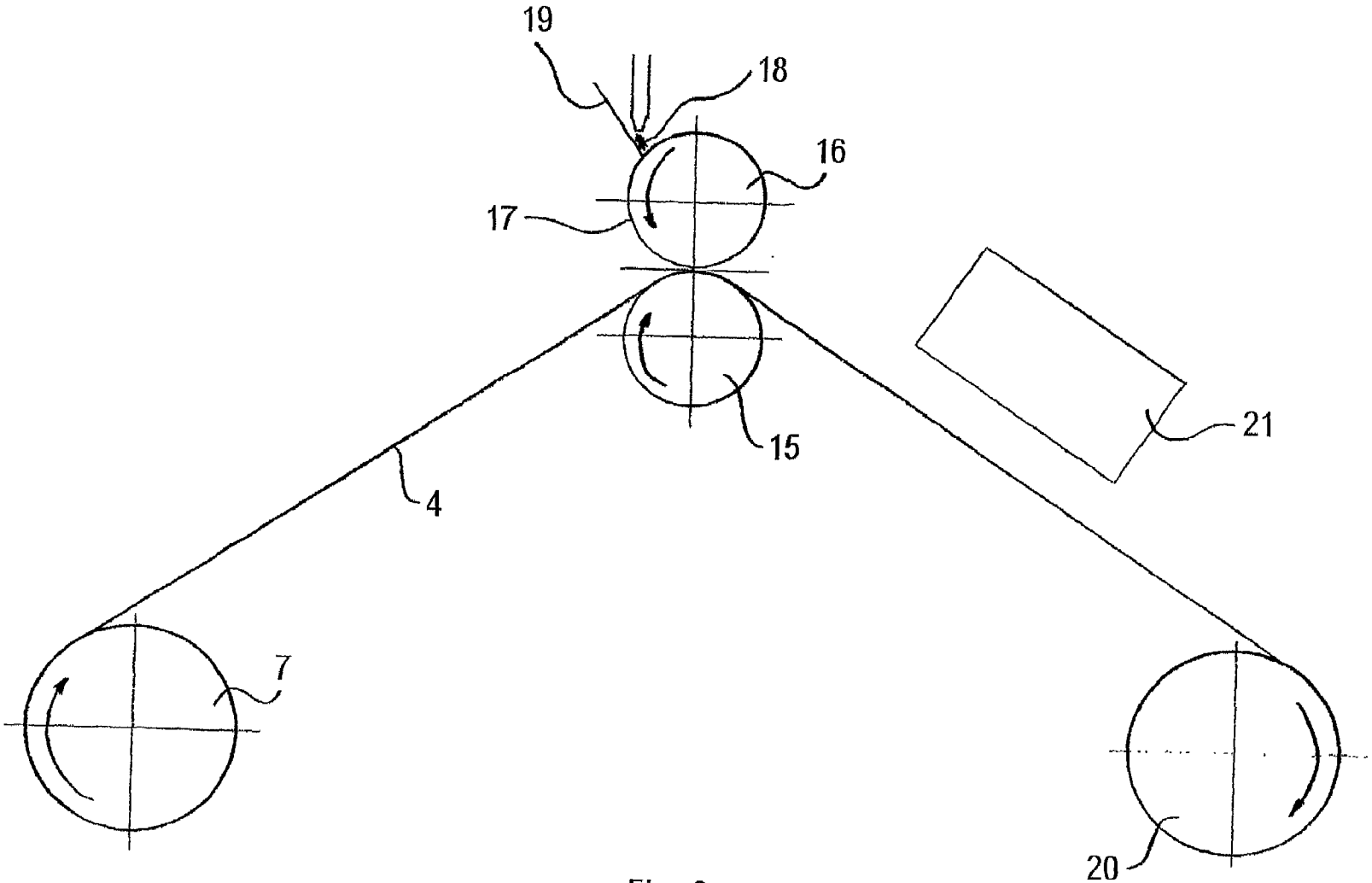
FIG. 8 is a drawing of the side of a contrivance for producing support means according to the invention, but in a second version.

FIG. 8 shows the paper sheet 4 being unwound from a reel 7 and partially wound around an idling roller 15, against which a distributor roller 16, which is preferably meshed, is pressed, on which a gas-impermeable layer 17 of barrier means 18 is applied by a blade 19 that acts against the external surface of the distributor roller 16. Thus in the contact zone between the distributor roller 16 and the idling roller 15, the gas-impermeable layer 17 is transferred to a face of the paper sheet 4: all the paper sheet 4 and the gas-impermeable layer 17 associated with it are wound on a winding reel 20 after moving through polymerization promoters 21 by means of which the layer of gas-impermeable material 17 is fixed to the paper sheet 4.

The invention claimed is:

1. Support means for sublimation decorations (2), comprising a paper sheet (4) having a sublimable decoration printed on one face thereof (4*a*), wherein barrier means (5; 17, 18) are permanently applied on a further face (4*b*) of said paper sheet (4) that is opposite the one said face (4*a*), the barrier means hindering the passage of air through said further face (4*b*)

and wherein said pater sheet (4) has a transverse dimension which is less than the transverse dimension of said barrier means (5; 17, 18).

2. Support means according to claim 1, wherein said barrier means (5; 17, 18) are arranged and formed so as not to prevent the passage of air transversely to the thickness of said paper sheet.

3. Support means according to claim 1, wherein said barrier means (5; 17, 18) comprise a polymeric material.

4. Support means according to claim 1, wherein said barrier means comprise a film (5; 17).

5. Support means according to claim 4, wherein gluing means (6) are placed between said paper sheet (4) and said film (5), said gluing means being arranged to firmly fix said paper sheet (4) to said film (5).

6. Support means according to claim 1, wherein said barrier means (17, 18) are associated with said paper sheet (4) in a fluid state.

7. Support means according to claim 1, wherein end zones (5*a*, 5*b*) are identified in said barrier means (5; 17, 18), which end zones are not clad by said barrier means (4) and can easily be joined to one another.

8. Support means according to claim 1, wherein said paper sheet (4) comprises paper fibres arranged parallel to the length of manufactured products (3) to be decorated.

9. Method for manufacturing support means (1) for sublimation decorations (2), comprising printing said decorations (2) on a face (4*a*) of a paper sheet (4) and permanently applying barrier means (5; 17, 18) on a further face (4*b*) of said paper sheet (4) that is opposite the one said face (4*a*), said barrier means (5; 17, 18) substantially preventing the passage of air through said further face (4*b*), wherein said permanently applying comprises providing said paper sheet (4) with a transverse dimension that is less than the transverse dimension of said barrier means (5; 17, 18).

10. Method according to claim 9, wherein said permanently applying is achieved by arranging and forming said barrier means (5; 17, 18) in such a way that they do not prevent the passage of air transversely to the thickness of said raper sheet 5.

11. Method according to claim 9, wherein said permanently applying comprises using a polymeric material for said barrier means (5; 17, 18).

12. Method according to claim 9, wherein said permanently applying comprises using a film (5; 17) for said barrier means.

13. Method according to claim 12, and also comprising placing between said paper sheet (4) and said film (5) gluing means (6) arranged to firmly fix said paper sheet (4) to said film (5).

14. Method according to claim 9, wherein said permanently applying comprises spreading said barrier means (18) in a fluid state on said paper sheet (4).

15. Method according to claim 9, wherein said permanently applying comprises spraying said barrier means (18) onto said taper sheet (4).

16. Method according to claim 9, and also comprising joining together end zones (5*a*, 5*b*) of said support means (1) in such a way that said support means (1) are wound around an object to be decorated (3).

17. Method according to claim 9, and also comprising arranging an object (3) to be decorated in such a way that paper fibres of said paper sheet (4) are arranged parallel to the length of said object (3).

18. Method according to claim 9, wherein said printing is achieved before said permanently applying.

19. Method according to claim 9, wherein said printing is achieved after said permanently applying.

* * * * *